US006152700A

United States Patent [19]

Ginies

[11] Patent Number: 6,152,700

[45] Date of Patent: Nov. 28, 2000

[54] HERMETIC COMPRESSOR WITH REMOTE TEMPERATURE SENSING MEANS

[75] Inventor: Pierre Ginies, Sathonay Village, France

[73] Assignee: Maneurop, Trevoux, France

[21] Appl. No.: 09/319,529

[22] PCT Filed: Dec. 5, 1996

[86] PCT No.: PCT/IB97/01511

§ 371 Date: Aug. 9, 1999

§ 102(e) Date: Aug. 9, 1999

[87] PCT Pub. No.: WO98/25030

PCT Pub. Date: Jun. 11, 1998

[30] Foreign Application Priority Data

Dec. 5, 1996 [FR] France ..... 96 15174

[51] Int. Cl.[7] ..... F04B 49/10

[52] U.S. Cl. ..... 417/32; 417/410.5; 417/902

[58] Field of Search ..... 417/32, 410.5, 417/902

[56] References Cited

U.S. PATENT DOCUMENTS

| | | | |
|---|---|---|---|
| 3,239,132 | 3/1966 | Frank et al. | 230/58 |
| 3,278,111 | 10/1966 | Parker | 230/17 |
| 3,874,187 | 4/1975 | Anderson | 62/230 |
| 4,431,388 | 2/1984 | Eber et al. | 418/2 |
| 4,969,801 | 11/1990 | Haseley et al. | 417/18 |
| 5,118,260 | 6/1992 | Fraser, Jr. | 417/18 |
| 5,200,875 | 4/1993 | D'Entremont et al. | 361/25 |
| 5,368,446 | 11/1994 | Rode | 417/18 |
| 5,509,789 | 4/1996 | Mizutani et al. | 417/32 |

*Primary Examiner*—Timothy S. Thorpe
*Assistant Examiner*—Timothy P. Solak
*Attorney, Agent, or Firm*—Lee, Mann, Smith, McWilliams, Sweeney & Ohlson

[57] ABSTRACT

Compressor of the type comprising an inlet (10) which opens into a low-pressure inlet chamber (9), an outlet (17) which opens into a high-pressure delivery chamber (15) or pressure chamber, these two chambers being arranged one on either side of a dividing wall (19), compressing means comprising a motor equipped with a thermal cut-out device which cuts the electrical supply to the motor when a predetermined temperature which also depends on the electric motor supply current, is exceeded. This compressor comprises means (18) of conveying heat from the pressure chamber (15) towards the thermal cut-out device (8) without forming a passage which allows gas to pass between the pressure chamber (15) and the inlet chamber (9). Use in scroll-type compressors.

24 Claims, 6 Drawing Sheets

HERMETIC COMPRESSOR WITH REMOTE TEMPERATURE SENSING MEANS

BACKGROUND OF THE INVENTION

The subject of the present invention is a hermetic compressor intended for circulating gas, such as a scroll-type compressor.

A hermetic compressor, particularly one for providing refrigeration, comprises a pump which raises the pressure of the gas between a low-pressure inlet chamber and a high-pressure pressure chamber or delivery chamber. The pump is operated by an electric motor which has a thermal cut-out device which breaks the electrical supply circuit to the motor when the temperature rises.

Document EP-B-0,480,560 relates to a scroll-type compressor equipped with a thermal cut-out device consisting of a heat-sensitive valve that opens when a predetermined value is reached so as to form a pipe providing communication between the pressure chamber and the inlet chamber of the compressor, when the refrigerant is flowing within the compressor, the motor thermal cut-out device cutting off the electrical supply to this motor.

However, the power supply to the motor is not cut off until the temperature within the entire compressor has increased considerably. This means that the break in power supply to the motor is delayed, and damaging overheat can occur locally within the compressor. The compressor can only be re-started once it has cooled down, and this cooling can be achieved only by thermal conduction through the hermetic chamber.

It should also be noted that placing the inlet chamber and the pressure chamber in communication with each other is not good for the compressor, insofar that it is not possible to be sure that this passage is correctly sealed during normal running conditions, as it is possible that the component that provides the temporary closure may, in time, react less reliably and thus adversely affect the compressor efficiency. Finally, in cases of this kind, the opening of the valve depends not only on the temperature but also on the difference in pressure between the pressure chamber and the inlet chamber, even though the electrical supply to the motor needs to be cut off only if the temperature is too high.

Document U.S. Pat. No. 5,186,613 describes a similar thermal cut-out device, in which a valve situated in a by pass pipe opens when the temperature exceeds a predetermined value. The by pass pipe for connection comes out close to the motor control switch that reacts to temperature, which switch is placed directly in the gas flow when the valve opens. This ensures that the motor is switched off quickly, avoiding a needless increase in temperature of certain regions of the compressor, which means that the compressor can be re-started relatively quickly.

However, in neither of the two devices defined above is the temperature of the pressurized gas assessed directly, insofar that the temperature-sensitive valves are mounted in thermal contact with a component that has significant mass. This means that the valves react to a value which is the result, on the one hand, of the temperature of the gas and, on the other hand, of the temperature of the component or components. Thus the temperature-sensitive valves cannot react to quick increases in temperature of the gas in the pressure chamber. It is somewhat doubtful that the valves will be able to open in an emergency situation, for example when an expansion valve in the external refrigeration circuit is jammed, insofar that the pressure on the inlet side of the compressor will have dropped considerably while the pressure and temperature of the outlet gas will have increased. This will mean that the differential pressure at the valves will be so high that tremendous force will be needed to open them. This in particular is why bi- metallic valves cannot open for high differential pressures.

SUMMARY OF THE INVENTION

The object of the invention is to provide a hermetic compressor, especially a scroll-type compressor, equipped with a thermal cut-out system in which the electrical supply to the motor is cut off quickly as soon as the predetermined temperature is reached, without the pressure in the pressure chamber or in the inlet chamber influencing this measurement. Furthermore, the object of the invention is to allow this electrical supply to be cut off while at the same time disassociating itself completely from any increase in the temperature of the surroundings and particularly any increase in the temperature of the hermetic casing, by taking account only of the temperature of the gas. Thus, if the electrical supply to the motor is cut off, the installation will be able to be re-started very quickly, as the machine as a whole will not have reached a high temperature and it will therefore not be necessary to wait for the temperature of the machine as a whole to drop before it can be switched on again.

For this, the compressor according to the invention, of the type comprising an inlet which opens into a low-pressure inlet chamber, an outlet which opens into a high-pressure delivery chamber or pressure chamber, compressing means comprising an electric motor equipped with a thermal cut-out device which allows the electrical supply to the motor to be cut off when a predetermined temperature is exceeded, comprises means of conveying heat from the pressure chamber towards the thermal cut-out device without forming a passage allowing gas to pass between the pressure chamber and the inlet chamber. In an alternative form, the low-pressure region and the delivery chamber are arranged one on either side of a dividing wall. The delivery region can also open into a high-pressure chamber which filters out pressure waves or acts as a muffler. The thermal cut-out device allows the electrical supply to the motor to be cut off as a function of temperature, an equivalent operation also takes the electric motor supply current into account.

The compressor motor thermal cut-out device is used without needing hot gas to be transferred within the compressor from the high-pressure region towards the low-pressure region. The cut-out device therefore reacts very quickly to cut off the power supply to the motor as soon as the temperature increases, without the damaging delay experienced in currently-known devices.

In a first embodiment, the compressor comprises a pipe, one end of which opens into the pressure chamber, which passes close to the motor thermal cut-out device and the other end of which opens into the pressure chamber. This arrangement makes it possible to benefit from the speed of the fluid stream at the outlet to improve the circulation of gas in the pipe.

To improve the response time of the thermal cut-out device, the pipe, the ends of which open into the pressure chamber, is in contact with the motor thermal cut-out device. This allows heat to be transmitted by conduction.

Advantageously, the downstream end of the pipe, the ends of which open into the pressure chamber, is fitted with a thermal valve allowing gas to pass through the pipe, once the valve has opened, only when the gas temperature is higher than the valve-opening reference temperature.

According to one embodiment of this compressor, the upstream end of the pipe, the ends of which open into the pressure chamber, is arranged close to the orifice through which gas is delivered by the compressor. This makes it possible to benefit from the speed of the gas or to increase the relative pressure difference between the two ends of the pipe and thus make it easier for gas to flow along the pipe.

Advantageously, in this case, the downstream end of the pipe, the ends of which open into the pressure chamber, is arranged close to the outlet of this chamber.

According to one possibility, at least one of the ends of the pipe, the ends of which open into the pressure chamber, is closed by a non-return delivery valve when the compressor is not running.

Furthermore, the pipe, the ends of which open into the pressure chamber, is thermally insulated except in its region close to the thermal cut-out device. This avoids needless heating of the gas surrounding the motor, which is advantageous if the inlet chamber of the compressor is connected to the chamber containing the motor.

According to another embodiment, this compressor comprises a heat duct, one end of which is in the pressure chamber, and the other end of which is in thermal contact with the motor thermal cut-out device. This type of heat duct is described in particular in the document U.S. Pat. No. 2,350,348. Advantageously, the compressor according to the invention comprises a heat duct whose operation is non-linear.

This is a very quick and efficient way of conveying heat and allows the invention to be used in a novel way.

For the reasons mentioned earlier, the heat duct is thermally insulated from the compressor components other than the pressure chamber and the motor thermal cut-out device.

According to one possibility, the heat duct consists of a thermally conductive hermetic outer casing partially filled with a fluid which can be both liquid and gaseous in the range of operation of the heat duct, the latter also containing a material that has capillary properties, for example a soft or porous material, through which the fluid can move by capillary effect in the opposite direction to the direction imposed by gravity, in the case of a vertical compressor.

The heat duct may be bent around in the pressure chamber to benefit from better contact with the pressurized gas, or may be coiled to achieve better contact with the motor cut-out device.

Advantageously, the hermetic compressor is a scroll-type compressor, the pump of which has two volutes which move relative to one another, at least one of which is driven by an electric motor equipped with a thermal cut-out device influenced in particular by the means of conveying heat from the pressure chamber.

In any case, the invention will be clearly understood from the description which follows, with reference to the diagrammatic appended drawing which, by way of non-limiting examples, depicts several embodiments of this compressor;

DETAILED DESCRIPTION OF THE PREFERRED EMBODIMENTS

Figure 1:
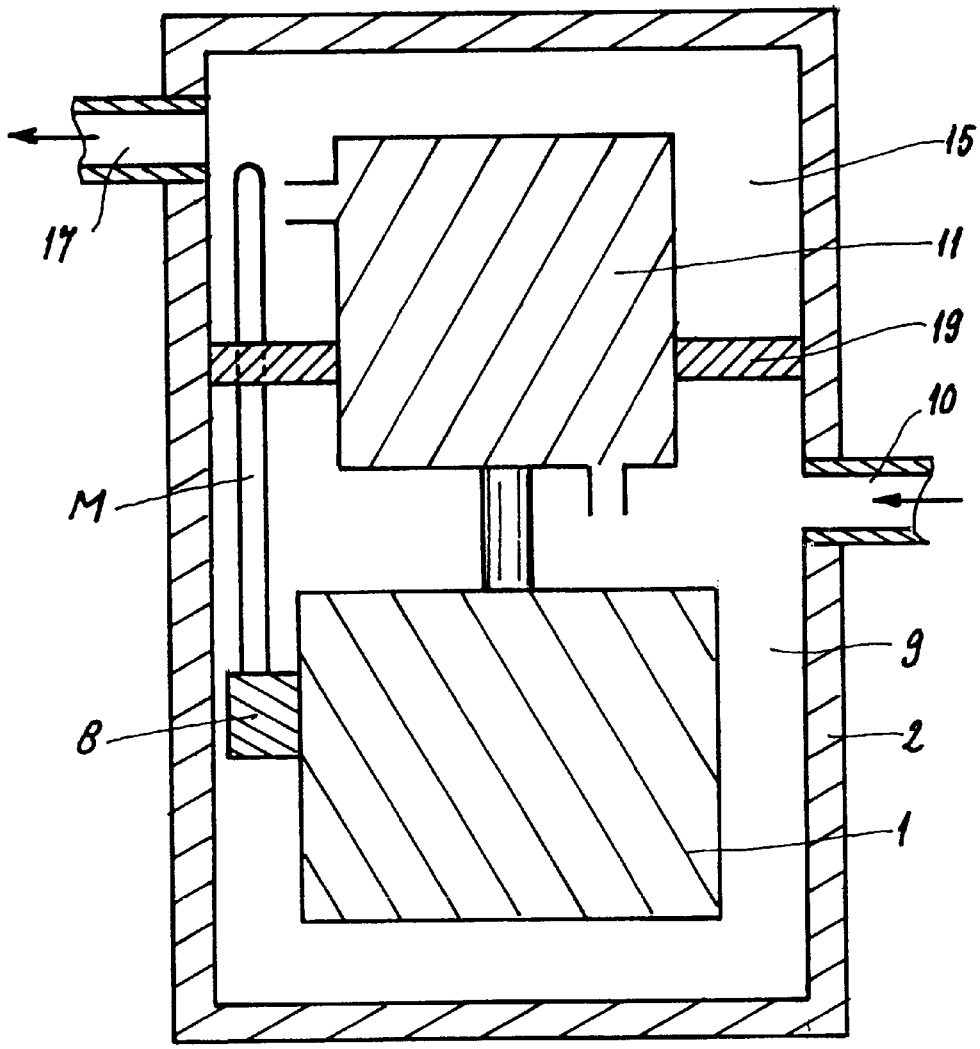
FIG. 1 is a sectional view illustrating the principle of the invention.

FIG. 1 is a very diagrammatical illustration of the principle of operation of a compressor according to the invention. This compressor comprises a hermetic casing 2 inside which there are an inlet chamber 9 fitted with an inlet for the gas, and a delivery chamber or pressure chamber 15, fitted with an outlet 17 for the gas. The inlet chamber 9 and pressure chamber 15 are separated by a dividing wall 19. Inside the inlet chamber 9 there is an electric motor 1 driving compressing means 11 which make the gas pass from the inlet chamber 9 to the pressure chamber 15 while compressing it. The motor 1 is fitted with a thermal cut-out device 8 which cuts off the electrical supply to the motor when the temperature exceeds a predetermined temperature.

According to the essential feature of the invention, the compressor is fitted with means M of conveying the heat assessed from the pressure chamber 15 towards the thermal cut-out device 8, without forming a passage which allows gas to pass between the pressure chamber 15 and the inlet chamber 9.

Figure 2:
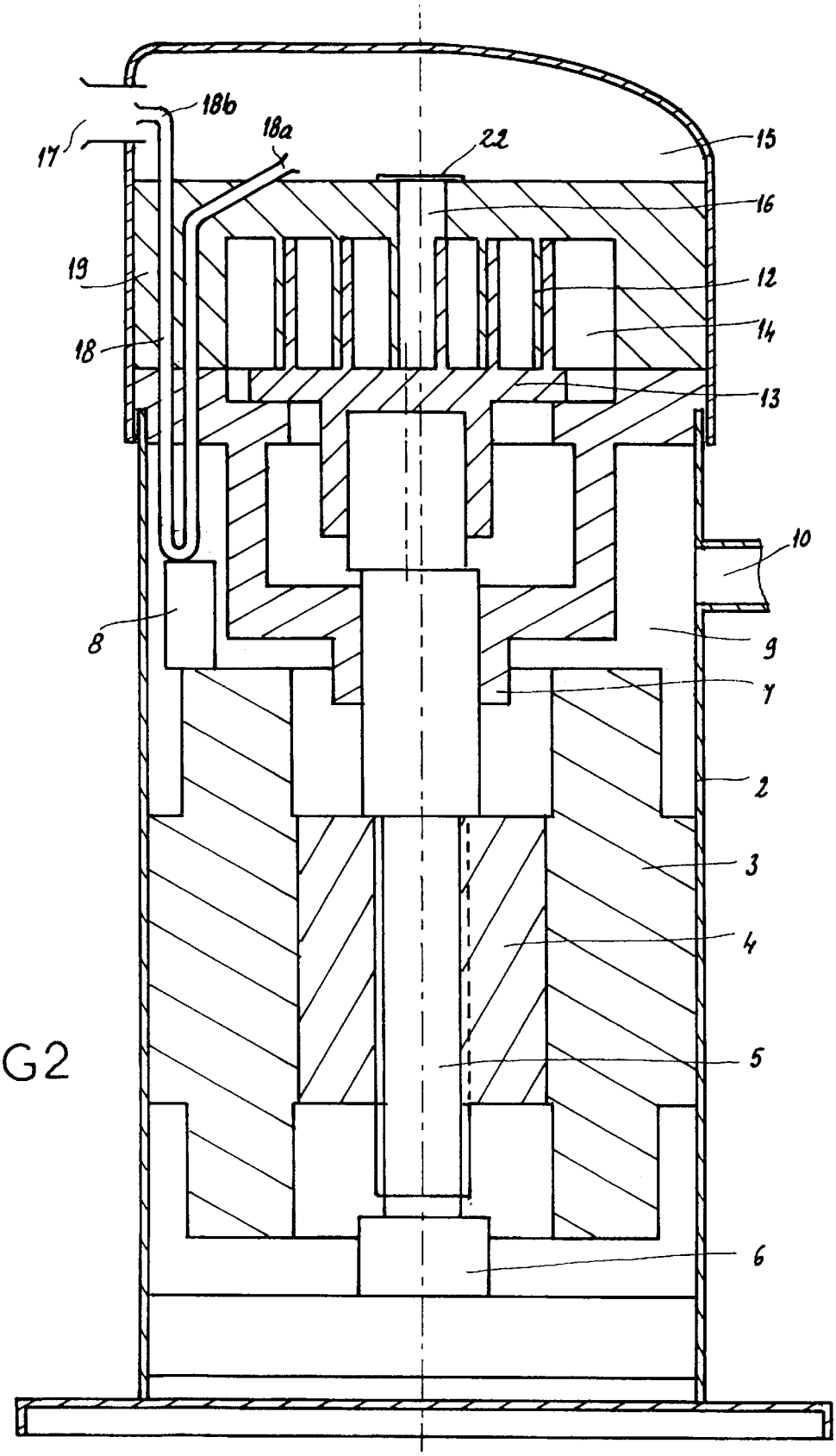
FIG. 2 is a sectional view of a first hermetic compressor.

The compressor depicted in FIG. 2 comprises a hermetic casing 2 containing an electric motor the stator 3 and the rotor 4 of which are depicted in the drawing. The rotor 4 is associated with a shaft 5 guided in rotation in a lower bearing 6 and upper bearing 7. Mounted on the upper wall of the motor is a thermal cut-out device 8 which cuts off the electrical supply to the motor as soon as a temperature higher than a reference temperature is reached. Inside the hermetic casing 2 there is a first chamber 9 or inlet chamber fed with gas through an inlet 10. The pump intended to raise the pressure consists of two volutes, a stationary volute 12 and a moving volute 13 driven by the motor shaft 5 and off centred with respect to the axis of this shaft, in the embodiment described.

Gas is let into the pump from the inlet chamber 9 into a chamber 14, is compressed, and enters a chamber 15 via the pump outlet 16 at the delivery pressure, the pressurized gas leaving the chamber 15 via an outlet 17.

In the embodiment depicted in FIG. 2, a pipe 18, the upstream end 18*a* and downstream end 18*b* of which are in the chamber 15, passes in leaktight fashion through a dividing wall 19 between the inlet chamber 9 and the pressure chamber 15. The upstream end 18*a* of the pipe 18 is advantageously close to the pump outlet 16, while the downstream end of the pipe 18 is close to the outlet 17 of the pressure chamber 15. The pipe 18 enters the chamber containing the motor, and comes into contact with the thermal cut-out device 8 thereof. Some of the gas flow is diverted through the pipe 18, so that should the temperature of the gas in the pressure chamber 15 rise, the motor cut-out device 8 will be acted upon immediately so that it can cut off the electrical supply to the motor if the conditions dictate this.

Figure 3:
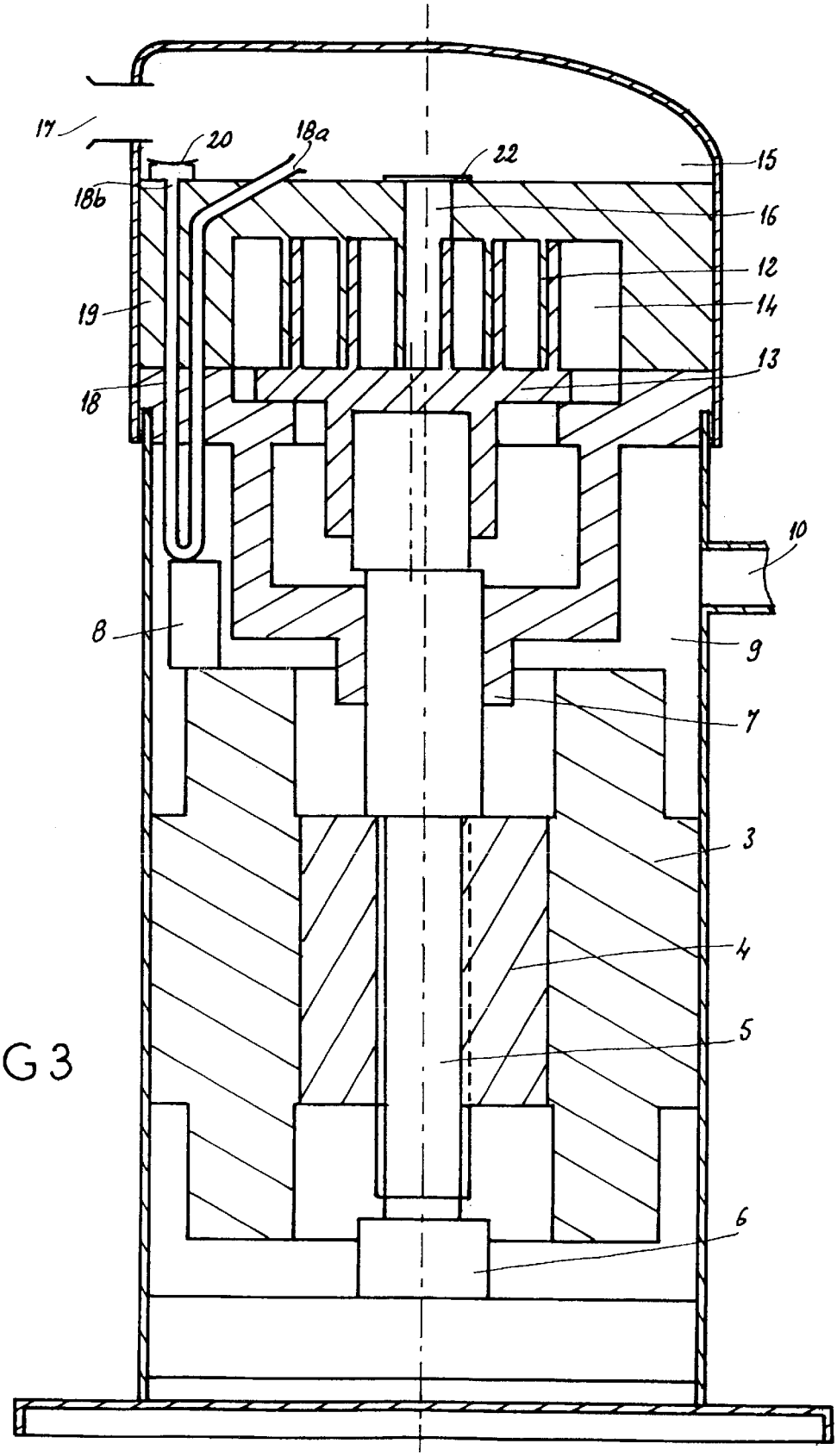
FIGS. 3 to 5 are views depicting three alternative forms of the same compressor.

FIG. 3 depicts an alternative form of the compressor depicted in FIG. 2, in which the same components are denoted by the same references as before. In this case, the downstream end 18*b* of the pipe 18 is fitted with a thermal valve 20 which allows gas to pass through the pipe 18, once the valve 20 has opened, only when the gas temperature is higher than the reference temperature at which this valve opens.

Figure 4:
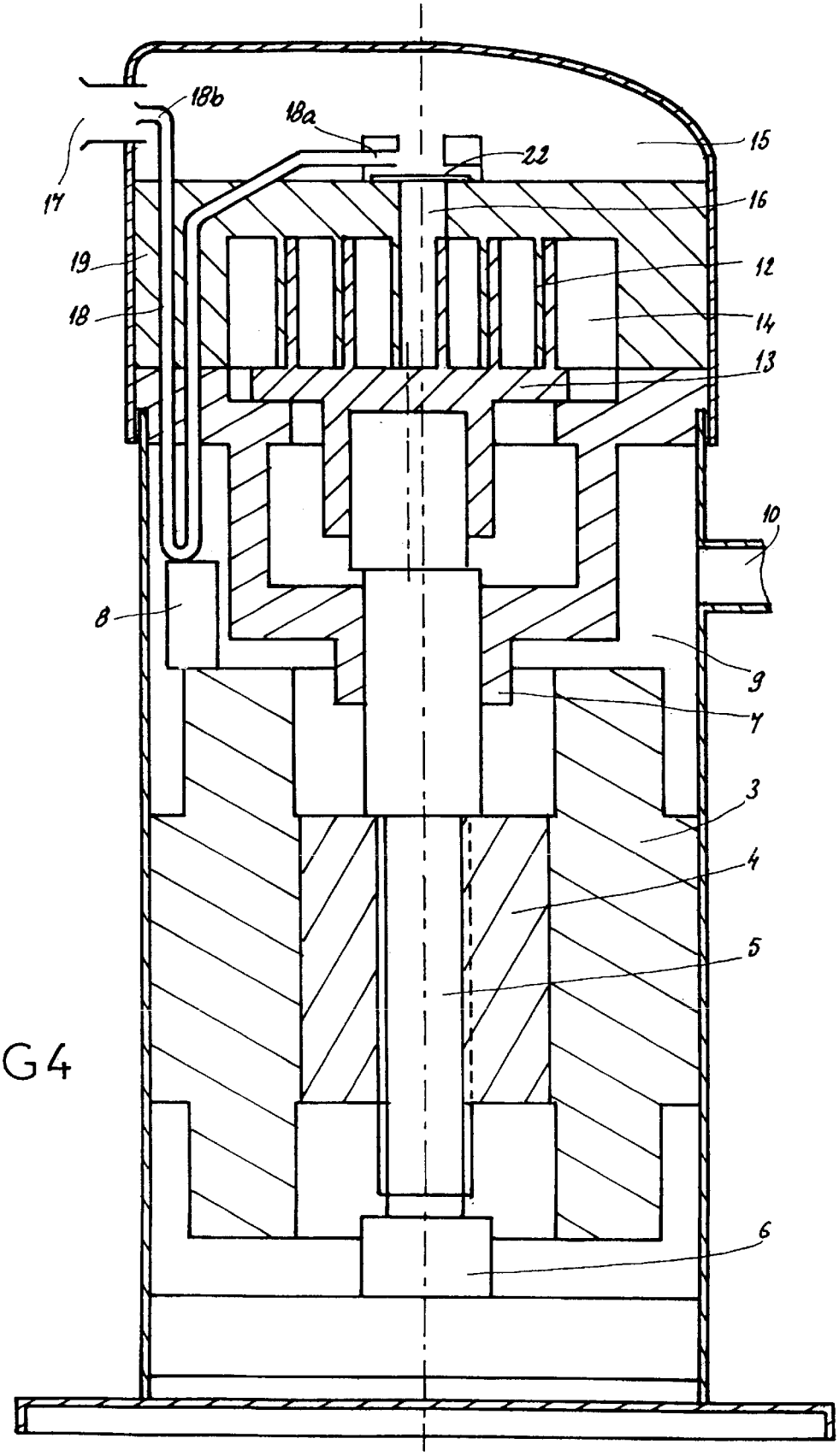

FIG. 4 depicts an alternative form of compressor of FIG. 2, in which the same components are denoted by the same references as before. In this case, the upstream end 18*a* of the pipe 18 is close to the pump outlet orifice 16, which is equipped with a non-return delivery valve 22.

Figure 5:
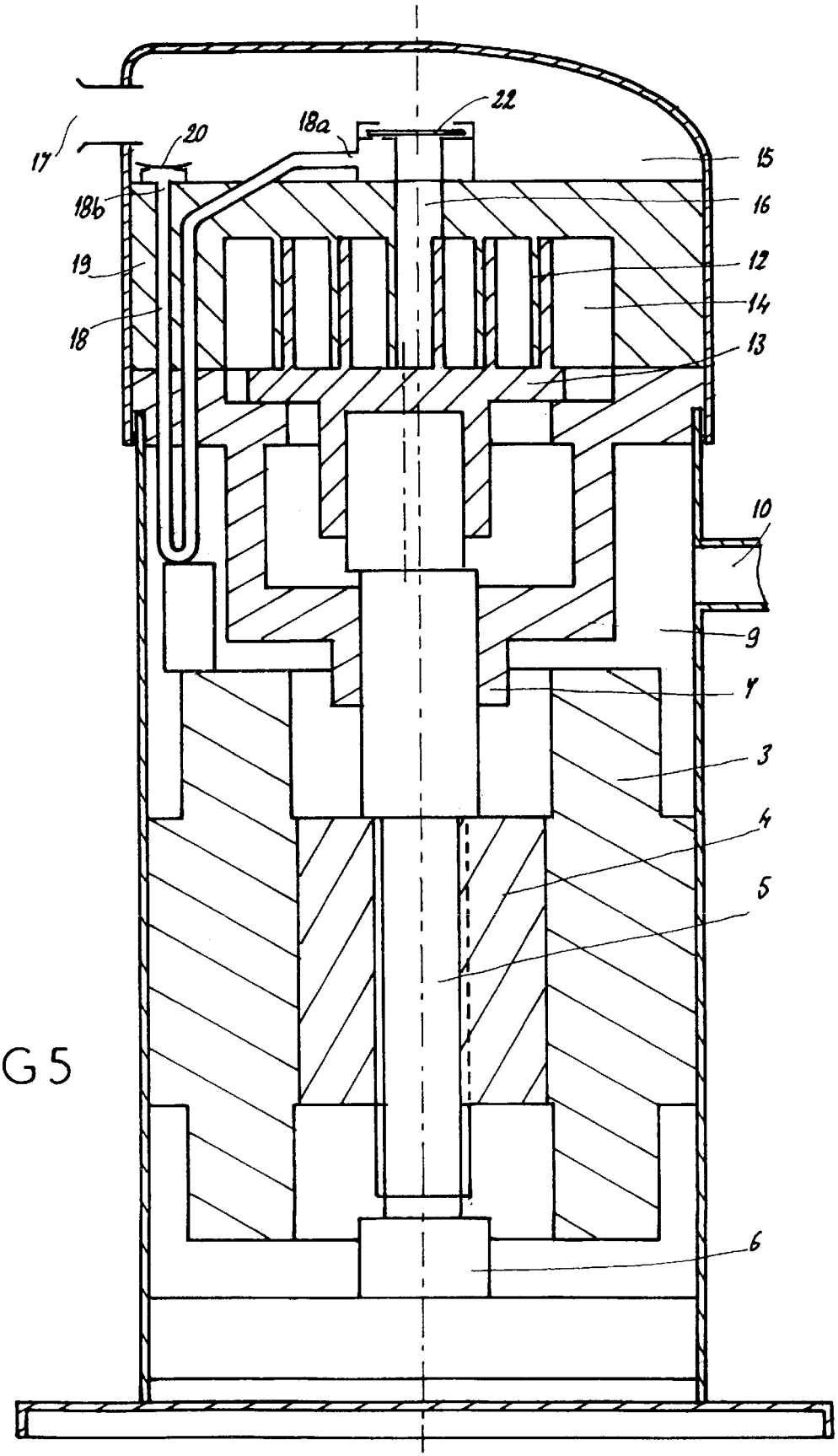

In the embodiment depicted in FIG. 5, which is an alternative form of FIG. 3, the upstream end 18*a* of the pipe 18 is closed by the non-return valve 22 when the compressor is not running.

It goes without saying that the various features described in FIGS. 2 to 5 could be combined in some other way, it being possible, for example, for the upstream end 18*b* of the pipe in FIG. 4 to be fitted with a thermal valve.

Although this has not been depicted in the drawing for reasons of drawing clarity and simplicity, the pipe 18 could be thermally insulated to avoid needless heating of the surroundings except in the region right by the thermal cut-out device 8.

Figure 6:
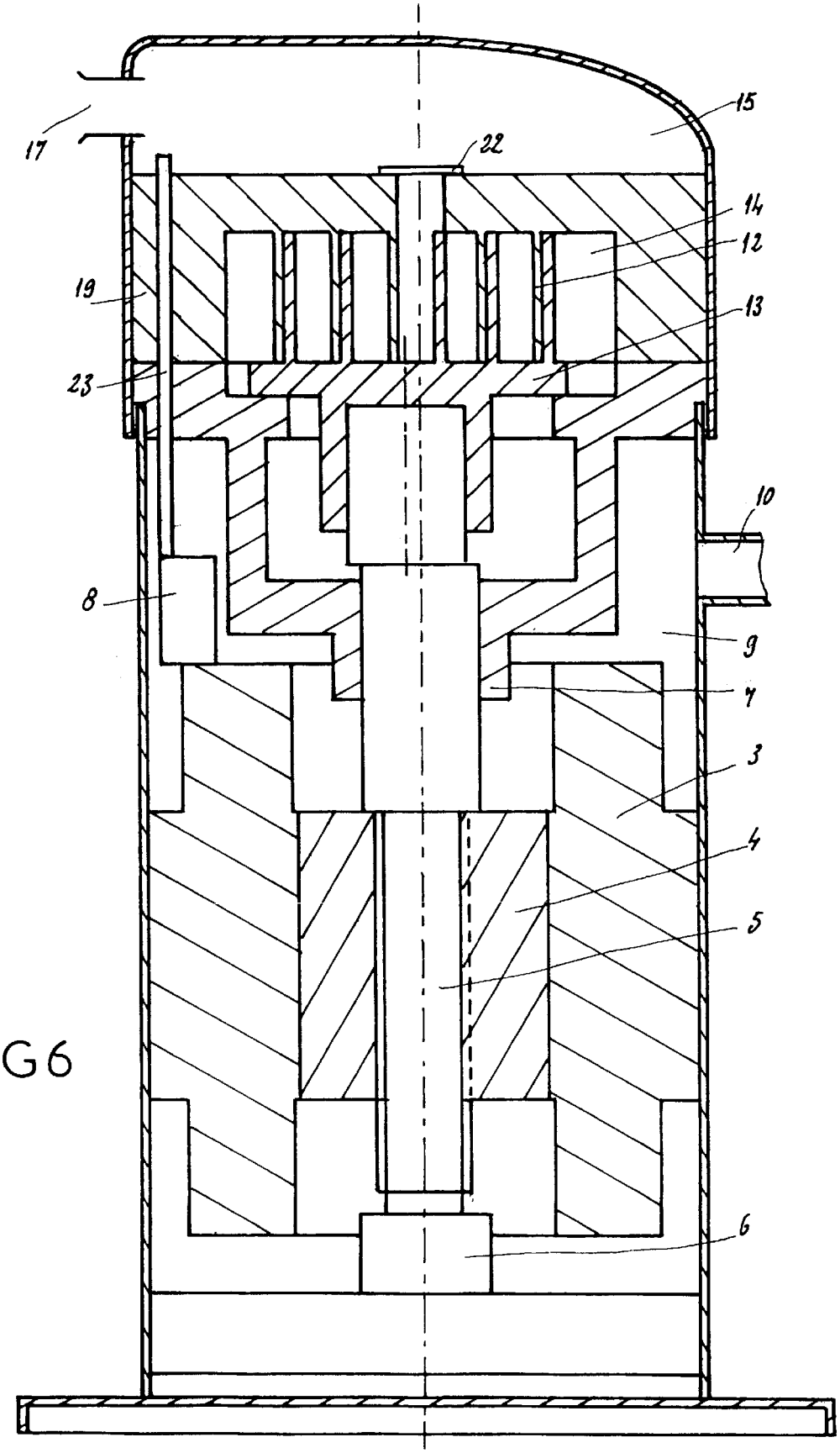
FIG. 6 is a view of a compressor of the same type fitted with another thermal cut-out system.

FIG. 6 is an alternative form of the invention, in which the means for conveying heat from the pressure chamber 15 towards the motor thermal cut-out device 8 consists of a heat duct 23 passing in leaktight manner through the dividing wall 19 between the pressure chamber 15 and the inlet chamber 9.

As is clear from the foregoing, the invention gives a great improvement to the current state of the art by providing a compressor equipped with a thermal cut-out system and especially a scroll-type compressor of a simple structure allowing the power supply to the motor to be cut off by taking only the temperature of the gas in the pressure chamber into account, without requiring the pressure chamber and the inlet chamber to communicate and without needing all of the components of the machine to have increased in temperature before the electrical supply is cut off.

As goes without saying, the invention is not restricted merely to the embodiments of this compressor which have been described hereinabove by way of examples, but covers all alternative forms thereof. Thus in particular, the means for conveying heat from the pressure chamber towards the thermal cut-out device could pass not through the dividing wall but around the outside of it, or alternatively, the invention could be aimed at compressors of other types: especially reciprocating-piston compressors, rotary-piston compressors, or screw- or spiral-type compressors, without this in any way departing from the scope of the invention.

What is claimed is:

1. Hermetic compressor intended for circulating gas, comprising an inlet which opens into a low-pressure inlet chamber, an outlet which opens into a high-pressure delivery chamber or pressure chamber, compressing means comprising an electric motor equipped with a thermal cut-out device which allows the electrical supply to the motor to be cut off when a predetermined temperature is exceeded, and means for conveying heat from pressure or delivery chamber to the thermal cut-out device without forming a passage which allows gas to pass between the pressure or delivery chamber and the inlet chamber.

2. Compressor according to claim 1, in which the heat conveying means comprises a pipe, one end of which opens into the pressure chamber, the pipe passing close to the motor thermal cut-out device and having another end which opens into the pressure chamber.

3. Compressor according to claim 2, in which the pipe is in contact with the motor thermal cut-out device.

4. Compressor according to claim 2, in which the other end of the pipe is fitted with a thermal valve which allows gas to pass through the pipe, once the valve has opened, only when the temperature of the gas is higher than a reference temperature at which the thermal valve opens.

5. Compressor according to claim 2, in which the one end of the pipe is arranged close to an orifice through which gas is delivered by the compressor.

6. Compressor according to claim 2, in which the other end of the pipe is arranged close to the outlet of the pressure chamber.

7. Compressor according to claim 2, in which at least one of the ends of the pipe is closed by a non-return delivery valve when the compressor is not running.

8. Compressor according to claim 2, in which the pipe is thermally insulated except in a region close to the thermal cut-out device.

9. Compressor according to claim 1, in which the heat conveying means comprises a heat duct, one end of which is in the pressure chamber, and the other end of which is in thermal contact with the motor thermal cut-out device.

10. Compressor according to claim 9, in which the heat duct is thermally insulated from the compressor components other than the pressure chamber and the motor thermal cut-out device.

11. Compressor according to claim 9, in which the heat duct consists of a thermally conductive hermetic outer casing partially filled with a fluid which can be both liquid and gaseous in a range of operation of the heat duct, the heat duct also containing a material that has capillary properties, through which material the fluid can move the capillary effect in a direction opposite to the direction imposed by gravity.

12. Compressor according to claim 1, in which the hermetic compressor is a scroll-type compressor having a pump which has two volutes which move relative to one another, at least one of which is driven by an electric motor equipped with the thermal cut-out device influenced by the means of conveying heat from the pressure chamber.

13. Compressor according to claim 1 wherein the heat is conveyed to a thermal cutout device mounted on the motor.

14. Compressor according to claim 13, in which the heat conveying means comprises a pipe, one end of which opens into the pressure chamber, the pipe passing close to the motor thermal cut-out device and having another end which opens into the pressure chamber.

15. Compressor according to claim 14, in which the pipe is in contact with the motor thermal cut-out device.

16. Compressor according to claim 14, in which the other end of the pipe is fitted with a thermal valve which allows gas to pass through the pipe, once the valve has opened, only when the temperature of the gas is higher than a reference temperature at which the thermal valve opens.

17. Compressor according to claim 14, in which the one end of the pipe is arranged close to an orifice through which gas is delivered by the compressor.

18. Compressor according to claim 14, in which the other end of the pipe is arranged close to the outlet of the pressure chamber.

19. Compressor according to claim 14, in which at least one of the ends of the pipe is closed by a non-return delivery valve when the compressor is not running.

20. Compressor according to claim 14, in which the pipe is thermally insulated except in a region close to the thermal cut-out device.

21. Compressor according to claim 13, in which the heat conveying means comprises a heat duct, one end of which is in the pressure chamber, and the other end of which is in thermal contact with the motor thermal cut-out device.

22. Compressor according to claim 21, in which the heat duct is thermally insulated from the compressor components other than the pressure chamber and the motor thermal cut-out device.

23. Compressor according to claim 21, in which the heat duct consists of a thermally conductive hermetic outer casing partially filled with a fluid which can be both liquid and gaseous in a range of operation of the heat duct, the heat duct also containing a material that has capillary properties, through which material the fluid can move by capillary effect in a direction opposite to the direction imposed by gravity.

24. Compressor according to claim 13, in which the hermetic compressor is a scroll-type compressor having a pump which has two volutes which move relative to one another, at least one of which is driven by an electric motor equipped with the thermal cut-out device influenced by the means of conveying heat from the pressure chamber.

* * * * *